US012516541B2

(12) United States Patent
Williams

(10) Patent No.: US 12,516,541 B2
(45) Date of Patent: Jan. 6, 2026

(54) MODULAR AIRFRAME TENT

(71) Applicant: Good inTents LLC, Wheat Ridge, CO (US)

(72) Inventor: Danielle Williams, Wheat Ridge, CO (US)

(73) Assignee: Good inTents LLC, Wheat Ridge, CO (US)

( * ) Notice: Subject to any disclaimer, the term of this patent is extended or adjusted under 35 U.S.C. 154(b) by 0 days.

(21) Appl. No.: 18/761,007

(22) Filed: Jul. 1, 2024

(65) Prior Publication Data

US 2025/0003251 A1 Jan. 2, 2025

Related U.S. Application Data

(60) Provisional application No. 63/609,181, filed on Dec. 12, 2023, provisional application No. 63/524,093, filed on Jun. 29, 2023.

(51) Int. Cl.
*E04H 15/20* (2006.01)
*E04H 15/58* (2006.01)

(52) U.S. Cl.
CPC ..... *E04H 15/20* (2013.01); *E04H 15/58* (2013.01); *E04H 2015/201* (2013.01)

(58) Field of Classification Search
CPC ... E04H 15/20; E04H 2015/201; E04H 15/58; E04H 15/22; E04H 2015/205; E04H 2015/208
See application file for complete search history.

(56) References Cited

U.S. PATENT DOCUMENTS 2,955,606 A * 10/1960 Walker ..... E04H 15/20 52/2.21
3,828,492 A * 8/1974 Schliemann ..... E04C 2/32 52/36.2
4,271,642 A * 6/1981 Karr ..... E04H 15/20 52/2.21
4,567,696 A * 2/1986 Malet ..... E04H 15/22 52/2.24
4,901,481 A * 2/1990 Seeley, Jr. ..... E04H 15/20 52/2.15
5,245,802 A * 9/1993 Davis ..... E04B 1/34315 135/97
5,570,544 A * 11/1996 Hale ..... E04H 15/20 52/2.18
5,761,852 A * 6/1998 Liu ..... E04H 15/20 446/478
6,263,617 B1 * 7/2001 Turcot ..... E04H 15/20 52/2.13
8,245,464 B2 * 8/2012 Saiz ..... A01G 9/1415 52/75
11,401,729 B2 * 8/2022 Cangemi ..... E04H 15/36
2008/0295417 A1 * 12/2008 Turcot ..... E04H 15/20 52/2.13

(Continued)

*Primary Examiner* — Adriana Figueroa
(74) *Attorney, Agent, or Firm* — Hall Estill Law Firm

(57) ABSTRACT

A modular tent includes an airframe that is inflatable to provide structural support to the modular tent and an inner tent supported on an inside part of the airframe. The modular tent also includes an outer shell supported on an outside part of the airframe. A tent with a tent body having a doorway disposed therein. The tent also includes an inflatable door hingedly connected to the tent body.

20 Claims, 9 Drawing Sheets

(56) References Cited

U.S. PATENT DOCUMENTS

| | | | | |
|---|---|---|---|---|
| 2011/0314747 | A1* | 12/2011 | Massey | A47C 19/12<br>135/96 |
| 2021/0246685 | A1* | 8/2021 | Brezan | E04H 15/36 |
| 2023/0193650 | A1* | 6/2023 | Rodgers | E04H 15/20<br>52/2.18 |

* cited by examiner

MODULAR AIRFRAME TENT

CROSS-REFERENCE TO RELATED APPLICATIONS

The present application is a conversion of U.S. Provisional Application having U.S. Ser. No. 63/524,093, filed Jun. 29, 2023 and U.S. Provisional Application having U.S. Ser. No. 63/609,181, filed Dec. 12, 2023, which claim the benefit under 35 U.S.C. 119(e). The disclosures of which are hereby expressly incorporated herein by reference.

STATEMENT REGARDING FEDERALLY SPONSORED RESEARCH OR DEVELOPMENT

Not applicable.

BACKGROUND OF THE DISCLOSURE

1. Field of the Invention

The present disclosure relates to a modular tent with an inflatable airframe and an inflatable door for a tent.

2. Description of the Related Art

Inflatable tents have been around for years, but there are limitations on their modularity. Tents have had various doors for entering and exiting a tent. Primarily, it is a loose piece of fabric that is zipped into place and when not zipped droops loosely from where it is attached. There have been some tent doors that are able to maintain a door structure that can be hinged open, but they require structural elements built into the tent to achieve this.

Accordingly, there is a need for a modular tent with an inflatable airframe to provide more usages of the tent and an inflatable door for a tent.

SUMMARY OF THE DISCLOSURE

The present disclosure is directed to a modular tent. The modular tent includes an airframe that is inflatable to provide structural support to the modular tent and an inner tent supported on an inside part of the airframe. The modular tent also includes an outer shell supported on an outside part of the airframe.

The present disclosure is also directed to a tent that has a tent body with a doorway disposed therein. The tent also includes an inflatable door hingedly connected to the tent body.

DETAILED DESCRIPTION OF THE DISCLOSURE

Figure 1:
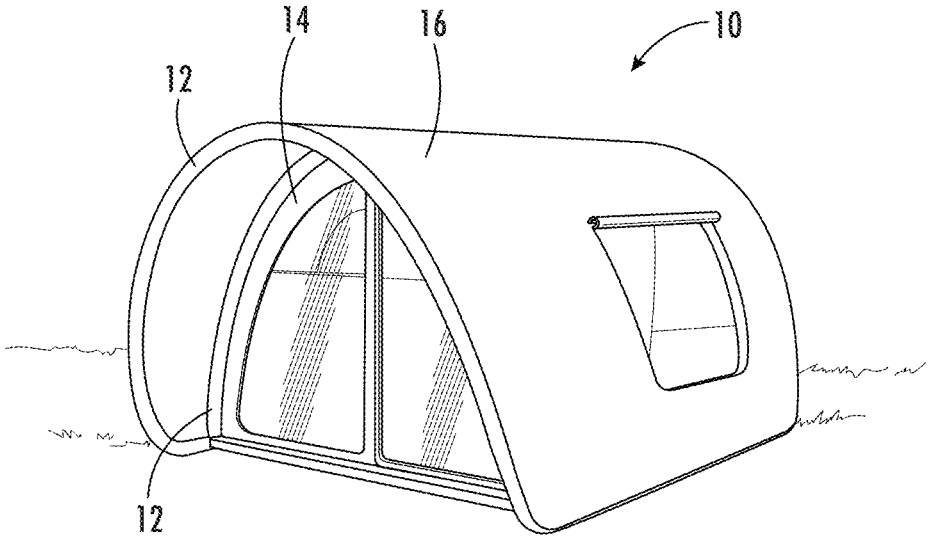
FIG. 1 is a perspective view of a modular frame tent constructed in accordance with the present disclosure.
Figure 2A:
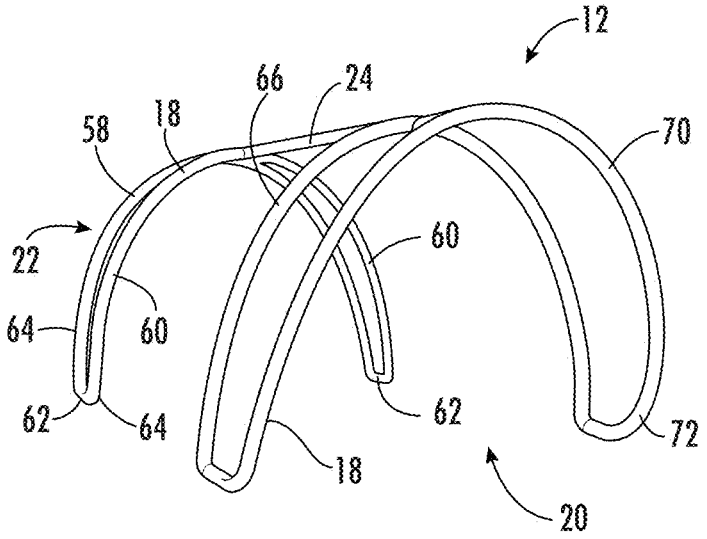
FIGS. 2A-2E are perspective views of the modular airframe tent in various configurations constructed in accordance with the present disclosure.
Figure 2B:
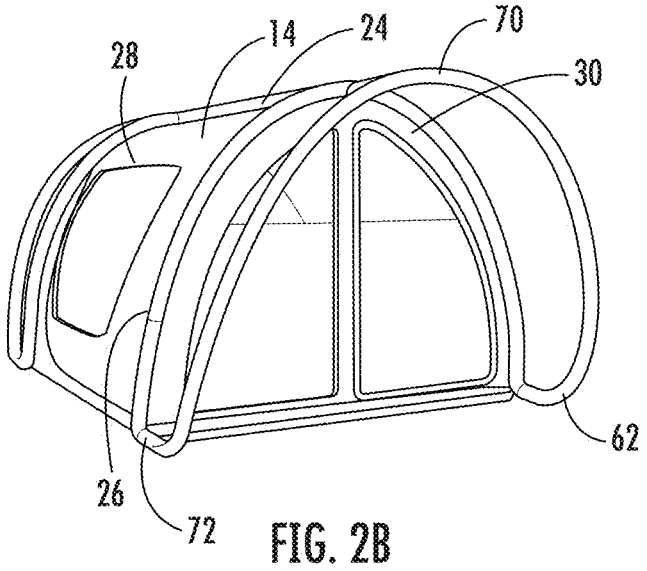
Figure 2C:
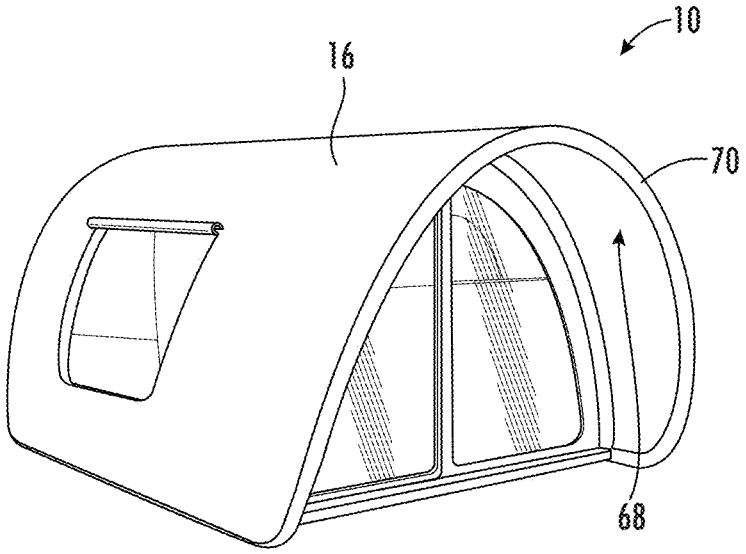
Figure 2D:
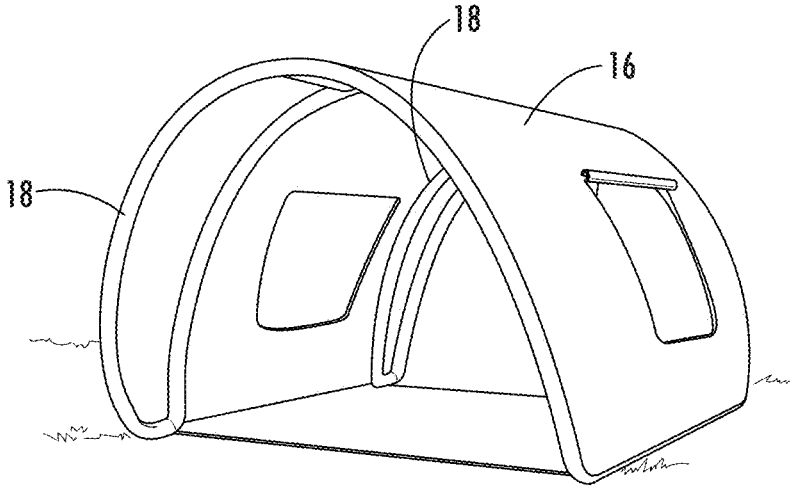
Figure 2E:
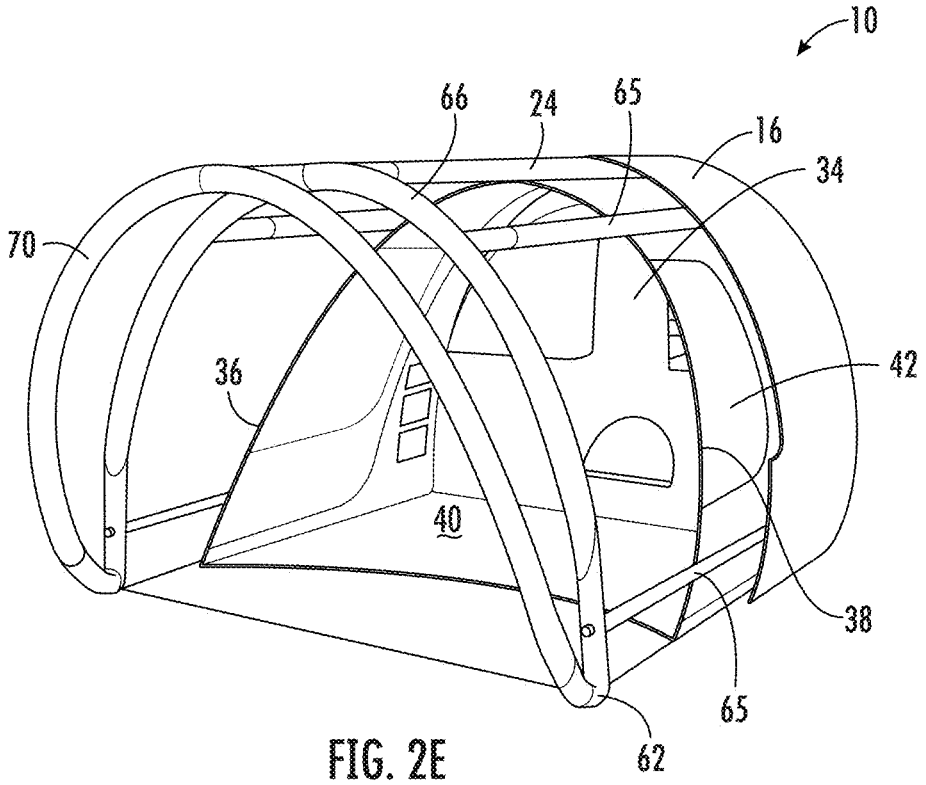

The present disclosure relates to a modular tent 10 with an inflatable airframe 12 shown in more detail in FIGS. 1-2E. In addition to the inflatable airframe 12, the modular tent 10 can include an inner tent 14 that is supported by the airframe 12 and an outer shell 16 that is also supported by the airframe 12. The inner tent 14 can be supported by the airframe 12 independently from the outer shell 16. Similarly, the outer shell 16 can be supported by the airframe 12 independently from the inner tent 14. When the outer shell 16 is supported by the airframe 12 without the inner tent 14, the modular tent 10 can essentially be a canopy tent (see FIG. 2D) with unfettered access via at least one open end. The inner tent 14 can be secured to the airframe 12 in any manner known in the art, such as via loops attached to the inner tent 14 and ties secured to the airframe 12. Or, the modular tent 10 could be set up where the loops are on the airframe 12 and the ties are on the inner tent 14. Similarly, the outer shell 16 can be secured to the air frame via any manner known in the art, such as via hook and loop strips attached to the outside of the airframe 12 and the inside of the outer shell 16.

The airframe 12 can be comprised of multiple tube sections 18 to hold air and support the inner tent 14 and the outer shell 16. Furthermore, the airframe 12 can have any shape such that the inner tent 14 and the outer shell 16 are properly supported by the airframe 12. All components of the airframe 12 can also be pneumatically connected such that the entire airframe 12 can be inflated from a single point. In one embodiment of the present disclosure, the airframe 12 can have a primary tube 24 that connects a front frame 20 of the airframe 12 and a back frame 22 of the airframe 12. The front frame 20 can support the front part 26 of the inner tent 14 and the back frame 22 can support the back part 28 of the inner tent 14.

The inner tent 14 can have a front 30 with a doorway 32 disposed therein, a back 34 opposite the front 30, a first and second side 36 and 38 extending from the front 30 to the back 34, and a floor 40 connecting the front 30, back 34 and the sides 36 and 38. In one embodiment, the inner tent 14 is disposed entirely within the airframe 12. The inner tent 14 can have mesh windows 42 in the front 30, back 34 or sides 36 or 38 that include window covers that can be open or closed from inside the inner tent 14.

Figure 3:
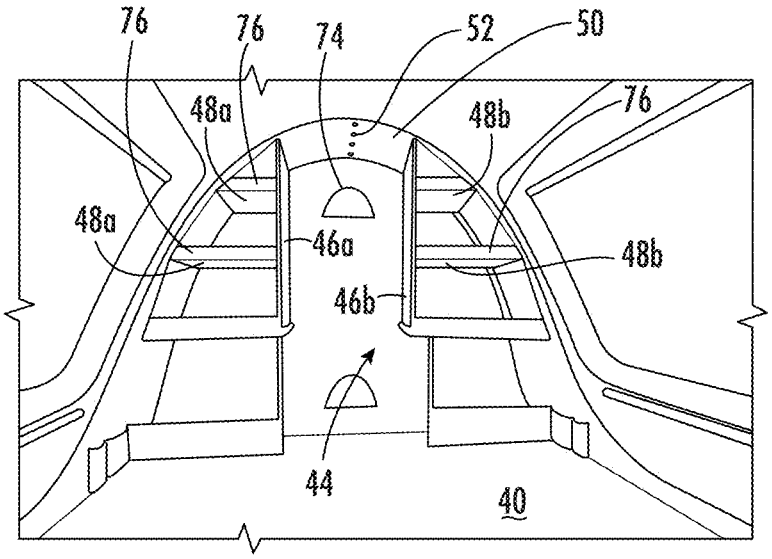
FIG. 3 is a perspective view of one embodiment of a part of the modular frame tent constructed in accordance with the present disclosure.

Referring now to FIG. 3, the inner tent 14 can also include a storage area 44. The storage area 44 includes walls 46 and shelves 48. The walls 46 are created from vertically disposed pieces of material that extend from a ceiling 50 of the inner tent 14 to the floor 40 of the inner tent 14. A first set of shelves 48*a* are positioned between one of the sides 36 of the inner tent 14, a first wall 46*a* and the back 34 of the inner tent 14. A second set of shelves 48*b* are positioned between the other side 38 of the inner tent 14, a second wall 46*b* and the back 34 of the inner tent 14. The ceiling 50 can include attachment points 52 between the first and second wall 36 and 38 to hang items, such as hangers with clothing on them. It should be understood and appreciated that the inner tent 14 could have more than just two walls 46 and any desired number of shelves 48.

Figure 4A:
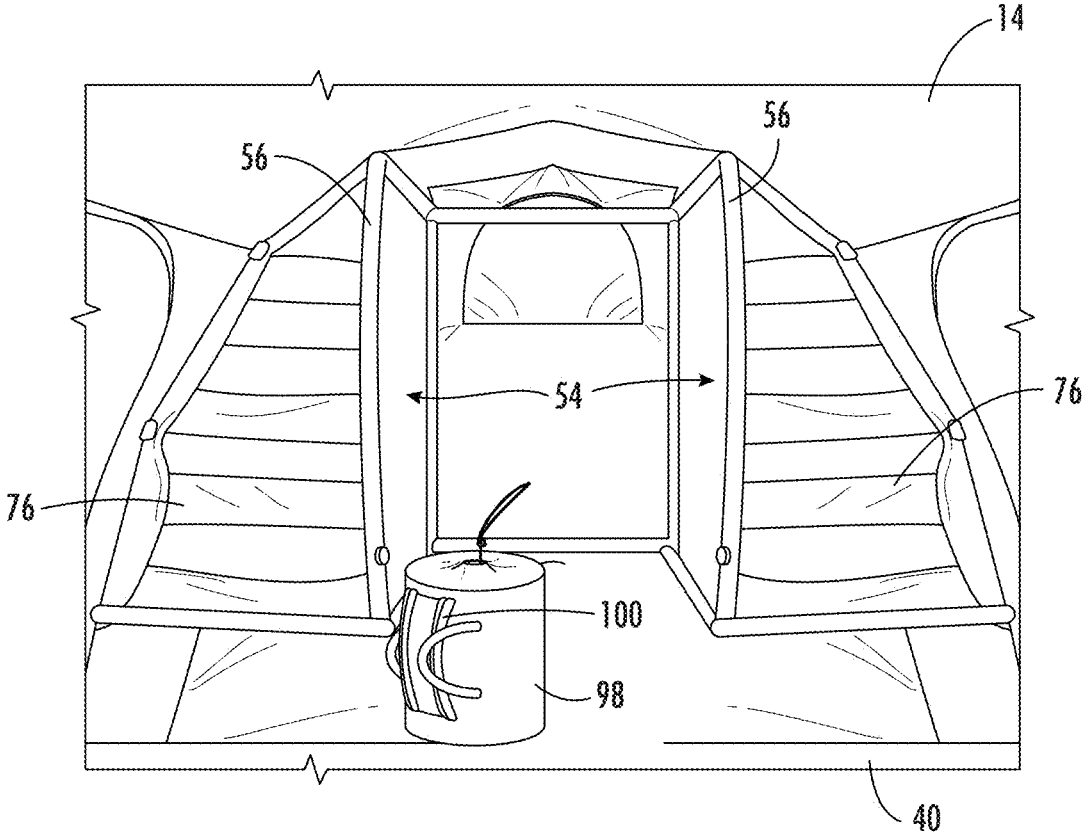
FIGS. 4A and 4B are perspective views of another embodiment of a part of the modular frame tent constructed in accordance with the present disclosure.
Figure 4B:
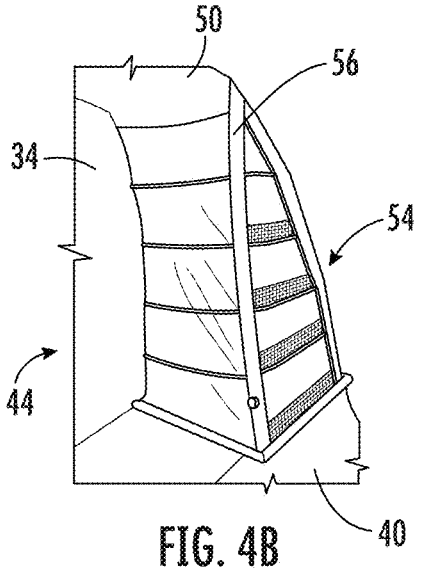

In another embodiment of the present disclosure shown in more detail in FIGS. 4A and 4B, the storage area 44 can include an inflatable frame 54 that provides support for the shelves 48 in the inner tent 14. The inflatable frame 54 can make up any portions of the shelves 48 as desirable. For example, the inflatable frame 54 can make up all edges of the shelves 48, or it can make up only the inner edges of the shelves 48. The inflatable frame 54 can also make up a vertical frame member 56 of the shelves. The inflatable frame 54 can also be set up to where parts of it could be built into the walls of the inner tent 14. The inflatable frame 54 can be designed to provide any parts of the shelf edges, sides, etc. The inflatable frame 54 can either be in pneumatic communication with the airframe 12 where the inflatable frame 54 is filled up when the airframe 12 is aired up. Or, the inflatable frame 54 can be inflated independently from the airframe 12 and have its own air intake point. In one embodiment, inflatable frame 54 and the shelves 48 can be a separate unit from the modular tent 10 and attached therein after the modular tent 10 has been set up. The inflatable frame 54 and/or shelves can be attached to the inner tent 14 in any manner known in the art such as via clips, hooks, carabiners, hook and loop strips, etc.

Referring back to FIG. 2A, the back frame 22 of the airframe 12 can have a first back tube 58 that is in general alignment and corresponds to the back 34 of the inner tent 14 and a second back tube 60 that is in general alignment with the front of the shelves 48 and the front of each of the first and second walls 46*a* and 46*b*. The first and second back tubes 58 and 60 can be separated by any desired distance such that the shelves 48 and the walls 46 have the desired depth. The first and second back tubes 58 and 60 can be arched and extend from the primary tube 24, which is the apex of the arched first and second back tubes 58 and 60, to the ground. In one embodiment, the first and second back tubes 58 and 60 terminate at the ground. In another embodiment, the ends 64 of the first and second back tubes 58 and 60 are connected by ground tubes 62.

In one embodiment, the primary tube 24 can be substantially horizontally disposed and extend from the back 34 of the inner tent 14 to the front 30 of the inner tent 14 when the modular tent 10 is set up and be the only part of the airframe 12 that extends from the back frame 22 to the front frame 20. The airframe 12 can include a first front tube 66 that is general alignment with the front 30 of the inner tent 14. In a further embodiment, the primary tube 24 can extend beyond the front 30 of the inner tent 14, and the first front tube 66, to provide a covered area 68 adjacent to the front 30 of the inner tent 14. To have proper support for the covered area 68, the primary tube 24 can extend to a second front tube 70 that supports the outer shell 16 that provides the covered area 68. The first and second front tubes 66 and 70 can be separated by any desired distance such that the covered area 68 has a desired size. Similar to the first and second back tubes 58 and 60, the first and second front tubes 66 and 70 can be arched and extend from the primary tube 24, which is the apex of the arched first and second front tubes 66 and 70, to the ground. In one embodiment, the first and second front tubes 66 and 70 terminate at the ground. In another embodiment, the ends 72 of the first and second front tubes 66 and 70 are connected by ground tubes 62. In addition to the primary tube 24, the airframe 12 can also include lateral tubes 65 extending from the back frame 22 to the front frame 20. It should be understood and appreciated that when the first and second back tubes 58 and 60 and the first and second front tubes 66 and 70 are arched, this will cause the sides 36 and 38 of the inner tent 14 to have an arched shape. Similarly, the outer shell 16 will have an arched cross-sectional shape.

The sides 36 and 38, the back 34 or the front 30 of the inner tent 14 can include vent ports 74 disposed therein. The vent ports 74 are created by a mesh opening in the inner tent 14. The inner tent 14 can have a piece of material that is bigger than the mesh opening on the outside that covers the mesh opening on a majority of the sides and top, but leaves the bottom open to allow some air flow through the vents, but prevents precipitation from entering the inner tent 14 via the mesh opening. The inner tent 14 can also include pockets secured to the inside thereof to provide a place to store items. Further, a divider 76 can be secured to each shelf 48, extend upward therefrom and expand between the walls 46 and the sides 36 and 38 of the inner tent 14 to help maintain position of items on the shelves 48. The divider 76 can also be secured to the walls 46 and the sides 36 and 38 of the inner tent 14 in addition to the shelves 48 themselves.

Referring now to FIGS. 5A-5E, the present disclosure is also directed to an inflatable tent door 78 that can be hingedly attached to the inner tent 14. The inflatable tent door 78 can include a door portion 80 that is roughly equal to the size of the doorway 32 disposed in the front 30 of the inner tent 14. The door portion 80 can be made of a flexible material similar to what the inner tent 14 or the outer shell 16 could be made of. Inflatable tubing 84 can be secured to at least part of an outer part of the door portion 80 to create a door frame. The inflatable tubing 84, once inflated, will provide the door frame, which will maintain the structure of the inflatable door 78 and prevent it from collapsing. The inflatable tubing 84 can extend around a portion of the outer part of the door portion 80 or it can extend around the entire outer part 80. The inflatable tubing 84 could be one single tube that is pneumatically connected or it could be made up of multiple sections. The inflatable door 78 and/or the front 30 of the inner tent 14 could include magnets 88 to provide a mechanism for releasably securing the inflatable door 78 to the doorway 32. The inflatable door 78 could also include a zipper 90 for being zipped shut to provide a more secure closing of the inflatable door 78.

Figure 5A:
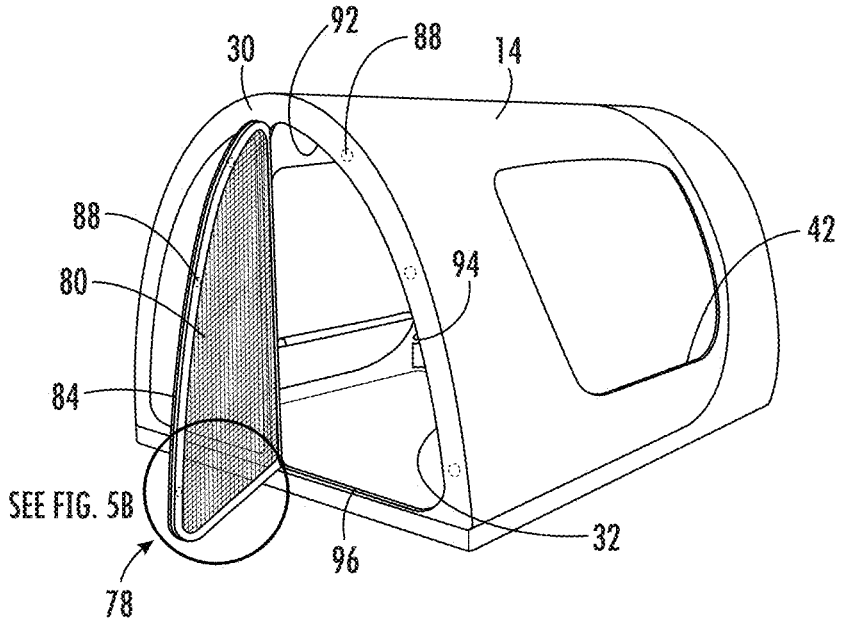
FIGS. 5A-5E are perspective views of another part of the modular frame tent constructed in accordance with the present disclosure.
Figure 5B:
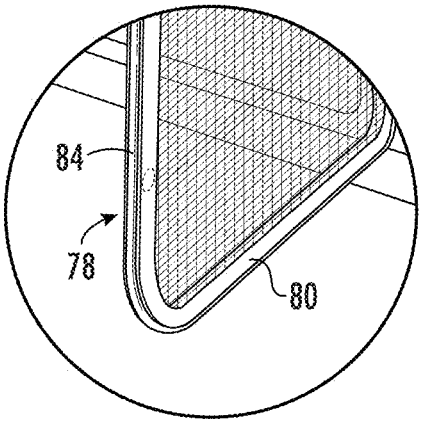
Figure 5C:
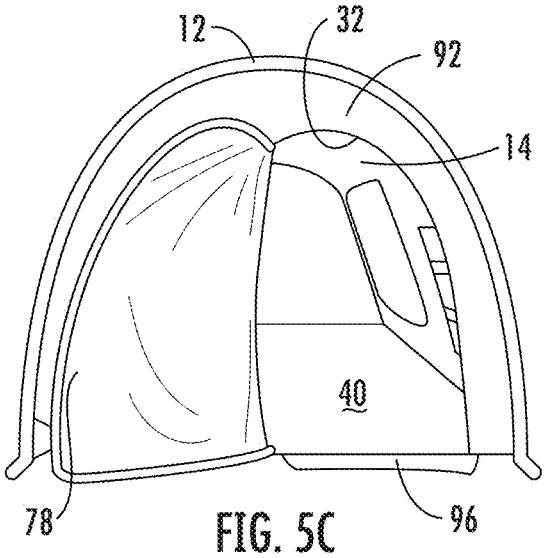
Figure 5D:
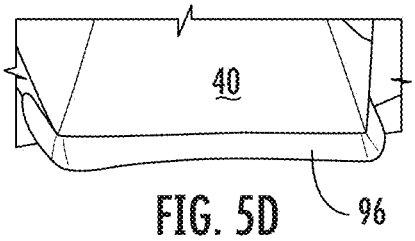
Figure 5E:
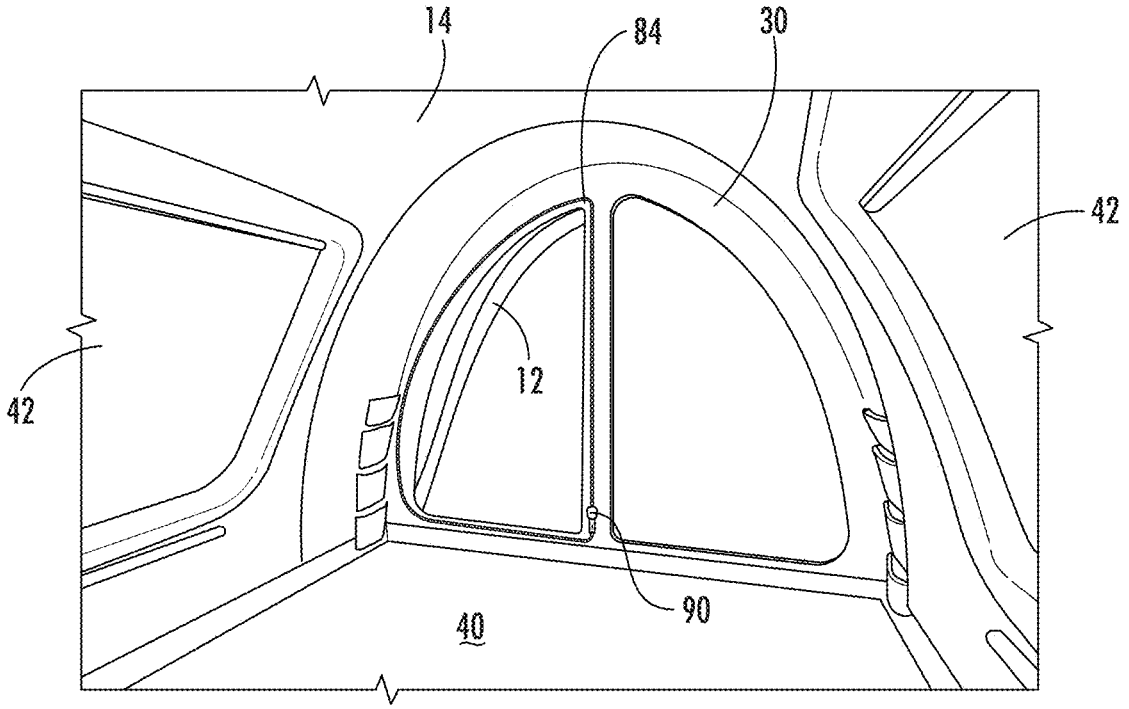

The doorway 32 can be defined by a top 92, sides 94 and a bottom portion 96. The bottom portion 96 can extend upward from the floor 40 of the inner tent 14. In one embodiment of the present disclosure, the bottom portion 96 can be selectively moved between an upright position (FIGS. 5A and 5E) to a laid over position (FIGS. 5C and 5D). The laid over position can be used to allow wheelchair access to the inside of the tent 10. The laid over position can also be used when the tent is first set up when all of the supplies are moved into the tent 10, which causes a person to walk in and out of the tent 10 repeatedly. When the bottom portion 96 is in the laid over position, the chances of a person tripping as they go in an out the door 78 is significantly reduced. The bottom portion 96 can be designed such that when the bottom portion 96 is in the upright position, water is precluded from entering the inner tent 14. The bottom portion 96 can also include some means for being selectively secured in the upright position. Any type of selectively securable fastening means can be used for the bottom portion 96 of the doorway 32, such as magnets, hooks and loops, strings for tying, etc. In another embodiment, the bottom portion 96 can include elastic edges that permit the bottom portion 96 to easily flex from the upright position to the laid over position to reduce the tripping hazard and/or permit a wheelchair easy access in and out of the tent 10.

In yet another embodiment of the present disclosure, the modular tent 10 can include a bag 98 that all parts of the modular tent 10 can be stored and transported in. After the contents of the modular tent 10 are removed from the bag 98, the bag 98 can be secured to an inside part of the inner tent 14 to provide a place for things to be collected. In an exemplary embodiment, the bag 98 could be used as a laundry hamper and dirty clothes could be placed in it. The bag 98 can be secured to any part of the inside of the inner tent 14 desirable and attached to the inside of the inner tent 14 in any manner desirable. For example, the bag could be held in place with clips, buckles, hook and loop strips, etc. The bag 98 can also include shoulder straps 100 to make carrying the tent 10 in the bag 98 easier.

From the above description, it is clear that the present disclosure is well-adapted to carry out the objectives and to attain the advantages mentioned herein, as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A modular tent having first and second sides, a front side and a back side, the modular tent comprising:

an airframe that is inflatable to provide structural support to the modular tent, the airframe includes ground tubes extending along the first and second sides of the modular tent and configured to abut the ground;

an inner tent selectively and removably supported on an inside part of the airframe;

an outer shell selectively and removably supported on an outside part of the airframe; and wherein the combined length of the ground tubes for each first and second side of the modular tent is substantially less than the length of each of the first and second sides of the modular tent.

2. The modular tent of claim 1 wherein the outer shell is supported by the airframe independently of the inner tent.

3. The modular tent of claim 1 wherein the airframe comprises:

a first back tube generally aligned with a back of the inner tent;

a first front tube generally aligned with a front of the inner tent; and a primary tube connecting the first back tube and the first front tube and extending along a top of the inner tent.

4. The modular tent of claim 3 further comprising a storage area having a wall extending from the inner tent and shelves extending between the wall and the inner tent.

5. The modular tent of claim 4 wherein portions of the wall and the shelves includes an inflatable frame.

6. The modular tent of claim 5 wherein the air frame further comprises a second back tube, the second back tube in general alignment with a front part of the wall to provide structural support for the shelves of the storage area.

7. The modular tent of claim 3 wherein the only connection between the first front tube and the first back tube is the primary tube.

8. The modular tent of claim 6 wherein the first back tube and the second back tube extend from the primary tube to the ground and are connected at the ground via the ground tubes.

9. The modular tent of claim 4 wherein the shelves can include dividers that extend upward therefrom between the wall and the inner tent to provide a means to prevent items from falling laterally off the shelves.

10. The modular tent of claim 3 wherein the airframe further comprises a second front tube extending from the primary tube beyond the front of the inner tent to create a covered area from the outer shell extending to the second front tube.

11. The modular tent of claim 1 wherein the inner tent can include vent ports, mesh windows and attachment points to hang items therefrom.

12. The modular tent of claim 1 further comprising a bag that the modular tent is carried in wherein the bag is securable in the inner tent to provide a place to store various items when the modular tent is set up.

13. The modular tent of claim 12 wherein the bag has shoulder straps to aide in carrying the modular tent during transportation of the modular tent.

14. A modular tent, the modular tent comprising:

an airframe that is inflatable to provide structural support to the modular tent;

an inner tent supported on an inside part of the airframe;

an outer shell supported on an outside part of the airframe;

a storage area having a wall suspended from the inner tent and shelves extending between the wall and the inner tent, the shelves and portions of the wall include an inflatable frame; and wherein the wall is unsupported by the ground and extends from the inner tent.

15. The modular tent of claim 14 wherein the air frame further comprises a second back tube, the second back tube in general alignment with a front part of the wall to provide structural support for the shelves of the storage area.

16. The modular tent of claim 14 wherein the shelves can include dividers that extend upward therefrom between the wall and the inner tent to provide a means to prevent items from falling laterally off the shelves.

17. The modular tent of claim 14 wherein the airframe comprises:

a first back tube generally aligned with a back of the inner tent;

a first front tube generally aligned with a front of the inner tent; and a primary tube connecting the first back tube and the first front tube and extending along a top of the inner tent.

18. The modular tent of claim 17 wherein the only connection between the first front tube and the first back tube is the primary tube.

19. The modular tent of claim 18 wherein the first back tube and the second back tube extend from the primary tube to the ground and are connected at the ground via ground tubes.

20. The modular tent of claim 17 wherein the airframe further comprises a second front tube extending from the primary tube beyond the front of the inner tent to create a covered area from the outer shell extending to the second front tube.

* * * * *